US007597572B2

(12) United States Patent
Chapman et al.

(10) Patent No.: US 7,597,572 B2
(45) Date of Patent: Oct. 6, 2009

(54) METHOD AND APPARATUS FOR IMPROVED UNIVERSAL SERIAL BUS CONNECTIVITY HAVING ELECTROSTATIC DISCHARGE PROTECTION GROUND ELEMENT

(75) Inventors: Cory A. Chapman, Raleigh, NC (US); Albert V. Makley, Raleigh, NC (US); Marc R. Pamley, Durham, NC (US); Kenneth Seethaler, Wake Forest, NC (US)

(73) Assignee: Lenovo Singapore Pte. Ltd, Singapore (SG)

( * ) Notice: Subject to any disclaimer, the term of this patent is extended or adjusted under 35 U.S.C. 154(b) by 272 days.

(21) Appl. No.: 11/528,833

(22) Filed: Sep. 28, 2006

(65) Prior Publication Data

US 2008/0081513 A1 Apr. 3, 2008

(51) Int. Cl.
*H01R 13/53* (2006.01)

(52) U.S. Cl. ..... 439/181

(58) Field of Classification Search ..... 439/181, 439/95

See application file for complete search history.

(56) References Cited

U.S. PATENT DOCUMENTS

| | | | | |
|---|---|---|---|---|
| 6,350,152 | B1 * | 2/2002 | Belopolsky et al. | 439/541.5 |
| 7,108,650 | B2 * | 9/2006 | Marzano | 493/191 |
| 7,410,370 | B2 * | 8/2008 | Sprouse et al. | 439/95 |
| 7,416,419 | B2 * | 8/2008 | Collantes et al. | 439/76.1 |
| 2003/0157836 | A1 * | 8/2003 | Morikawa et al. | 439/607 |

* cited by examiner

*Primary Examiner*—Briggitte R Hammond
(74) *Attorney, Agent, or Firm*—Sawyer Law Group

(57) ABSTRACT

Aspects of the present invention include a method and apparatus for an improved USB device having ESD protection. Uniquely including and positioning a discharge plane of a low resistance within a USB connection that is connectable with the ground of the USB connector, creates a discharge gap area where excess ESD charge may jump and discharge prior to the connection of paired USB devices having connectable connections.

6 Claims, 5 Drawing Sheets

METHOD AND APPARATUS FOR IMPROVED UNIVERSAL SERIAL BUS CONNECTIVITY HAVING ELECTROSTATIC DISCHARGE PROTECTION GROUND ELEMENT

FIELD OF INVENTION

The present invention relates generally to universal serial bus (USB) connectivity and more particularly relates to an improved USB connection having electrostatic discharge (ESD) protection.

BACKGROUND OF THE INVENTION

It is widely known to attempt to deploy complex circuits for electrostatic discharge protection (ESD) protection with various electronic circuitry and sophisticated electronic devices. It also known that even with sophisticated ESD circuitry, in many situations, an ESD protection circuit does not act rapidly enough to prevent electrostatic damage to the circuitry of interest. Oftentimes there are resistance/voltage disparities that can be too high in most electrostatic discharge protection circuits causing them to lose protection on high voltage ESD spikes. In the other extreme, some protection circuits do not function well at low voltages.

Consumers are often unclear about the dangers or effects of ESD and do not always realize that static charge may build up on the USB device. Occasionally, when a static charge builds up on a USB device which is then plugged into a USB socket, the static charge is transmitted to signal lines of the socket, plug or connector, which can then damage the USB device, an attached computer board, or any other electronic or silicon device connected thereto.

As a result, consumers are often perplexed when their USB peripherals, devices, ports, hubs, plugs, sockets, links and any other equipment having or being capable of being placed into operative communications with a USB plug or port (hereinafter used collectively as "USB device"), is damaged after being subject to discharge or damage from an ESD shock ("ESD hit"). In part, part of this confusion arises because as there is no visual damage to the affected device(s). Another similar result can be that of "latch up" which results in creating a low-impedance path between the power signal of an electronic component inadvertently that triggers a parasitic device to acts as a short circuit; often times the latch up will lead to improper function of the electronic device (e.g. USB device) or even its destruction due to a resulting overcurrent.

A "USB device" may further include and is not limited to any of the following, each being hot-swappable and/or having a USB connector or connection capability: Printer, Scanner, Mouse, Joystick, Flight yoke, Digital camera, Webcam, Cellular phone, Scientific data acquisition device, Computer, Computer System, Modem, Speaker, Telephone, Video phone, Storage device, Home appliance, and Network connection. A "USB device" may comprise a Type A connection (which is oriented to head "upstream" towards the computer), a Type B connection (which is oriented to head "downstream" away from the computer and connects to individual devices), a USB socket, or any other connection capable of USB connectivity. "USB connection" or "USB connector" may be used interchangeably and includes a USB plug or USB socket, of any Type or style, powered or unpowered.

Figure 5:
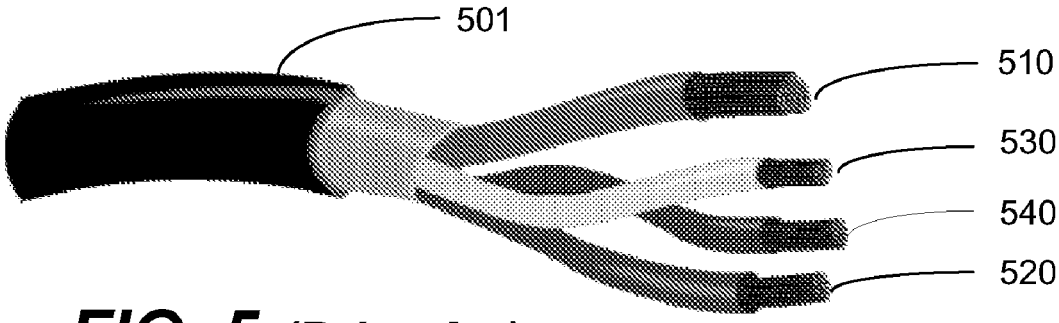
FIG. 5 (Prior Art)

FIG. 5 depicts a typical USB cable (501) being shielded and comprised of four wires (i.e., signal pins or lines), two of which carry power (510 and 520), wherein 510 typically carries 5 volts and 520 is a ground, and two of which carry data (530 and 540) which are typically twisted pair.

Figure 6:
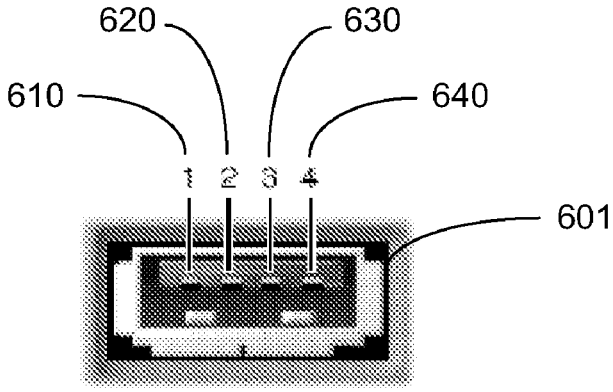
FIG. 6 (Prior Art)

FIG. 6 depicts a typical signal pin configuration (610, 620, 630, 640) for a typical USB connection, wherein each pin is connected to a USB cable wire (not shown), such as those of FIG. 5.

Figure 7:
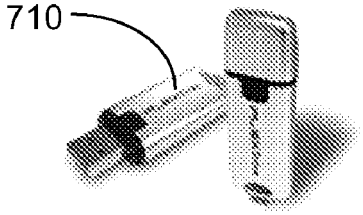
FIG. 7 (Prior Art)

FIG. 7 depicts a typical thumb drive as a USB device (710).

However, the use of external metal shielding surrounding a USB device's plastic housing (often near the USB connector), which in turn surrounds the two data lines and two power lines of the USB connector, has been ineffective and may inadvertently cause the exposed external metal shield to attract additional ESD charges even after being operatively connected.

Unfortunately, these external efforts and those of the complex ESD circuitry are often too costly, inadequate and can be too obtrusive to be used with USB devices; additionally, these efforts often do not satisfy spatial constraints at connection ports which have been further limiting dimensional footprints of many USB devices as computers and peripherals continue to become smaller in size.

Accordingly, what is needed is a method and apparatus for providing ESD protection to USB devices that is easily implemented, compatible with all (or most) existing technologies, is cost effective, and is of minimal dimensional impact to the USB device.

SUMMARY OF THE INVENTION

The present invention fulfills these needs and has been developed in response to the present state of the art, and in particular, in response to the problems and needs in the art that have not yet been fully solved by currently available security protocols and technologies.

An apparatus of an improved USB device having ESD protection is disclosed.

A method for providing an improved USB device having ESD protection is also disclosed.

In one embodiment, the improved USB device having ESD protection is an apparatus comprising a USB connector having a discharge plane of a low resistance connectable with the ground of the USB connector.

In another embodiment of the present invention, an apparatus comprising a USB connector having an internal discharge plane configurably arranged to discharge static energy of the USB connector prior to the USB connector being connected with it paired USB connection counterpart, is provided.

In another embodiment of the present invention, an apparatus comprising a USB device with a USB connector having an internally and angularly arranged ground element configured to discharge static energy of the USB device through the ground element prior to the USB connector of the USB device being connected with it paired USB connection counterpart, is provided.

In one methodical embodiment, a method improving a USB device comprising the steps of arranging a grounding element internal to the USB device to create an exposed gap area, is also disclosed.

Further embodiments, forms, objects, features, advantages, aspects, and benefits of the present application shall become apparent from the detailed description and drawings included herein.

BRIEF DESCRIPTION OF THE DRAWING(S)

Figure 1:
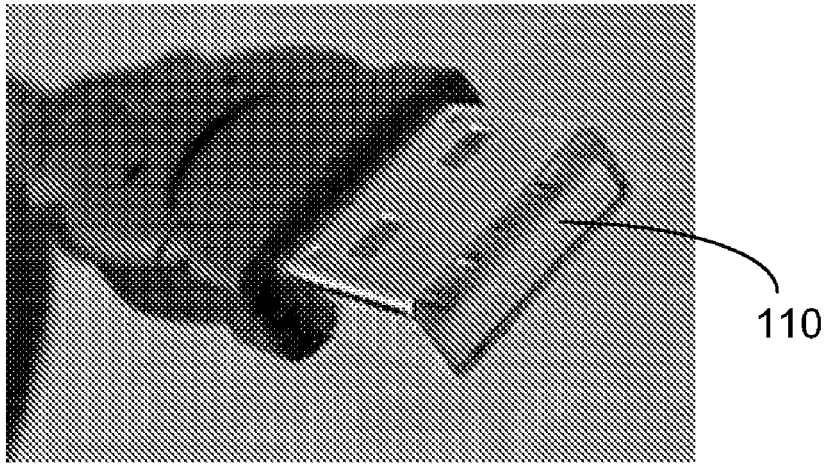
FIG. 1 (Prior Art)
FIG. 1 depicts a typical Type A USB connector (110).

FIG. 1 depicts a typical Type A USB connector.

Figure 2:
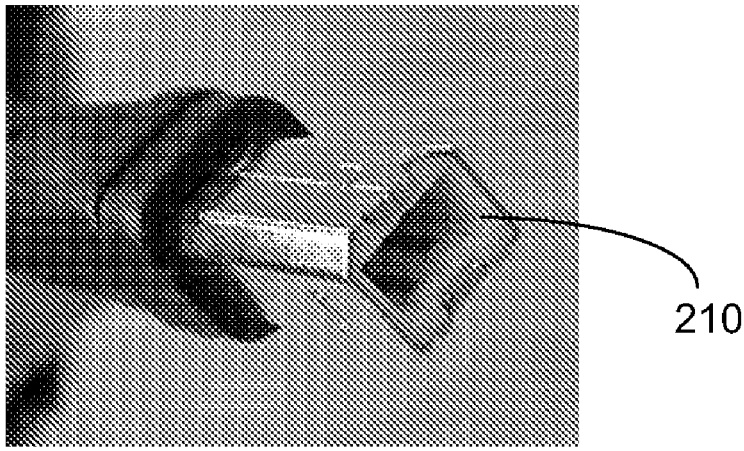
FIG. 2 (Prior Art)
FIG. 2 depicts a typical Type B USB connector (210).

FIG. 2 depicts a typical Type B USB connector.

Figure 3:
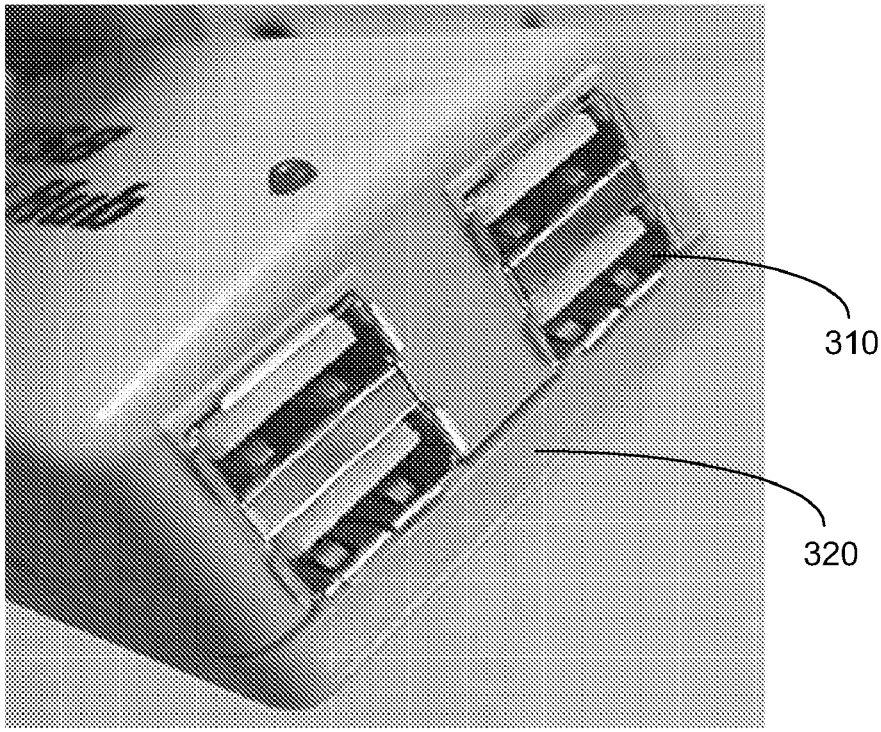
FIG. 3 (Prior Art)
FIG. 3 depicts a typical USB socket (310) in a hub (320) configuration.

FIG. 3 depicts a typical USB socket in a hub configuration.

Figure 4:
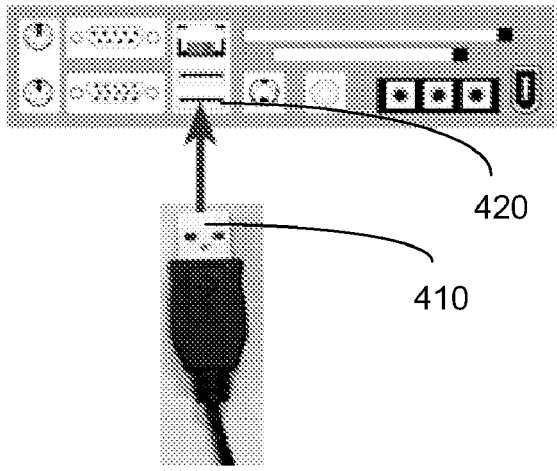
FIG. 4 (Prior Art)
FIG. 4 depicts a typical Type A USB connector (410) arranged for connection with its USB-paired socket (420).

FIG. 4 depicts a typical Type A USB connector arranged for connection with a typical USB socket.

FIG. 5 depicts a typical USB cable being shielded and comprised of four wires, two of which carry power and two of which carry data.

FIG. 6 depicts a typical signal pin configuration for a typical USB connection, wherein each pin is connected to a USB cable wire, such as those of referenced FIG. 5.

FIG. 7 depicts a typical thumb drive as a USB device.

Figure 8:
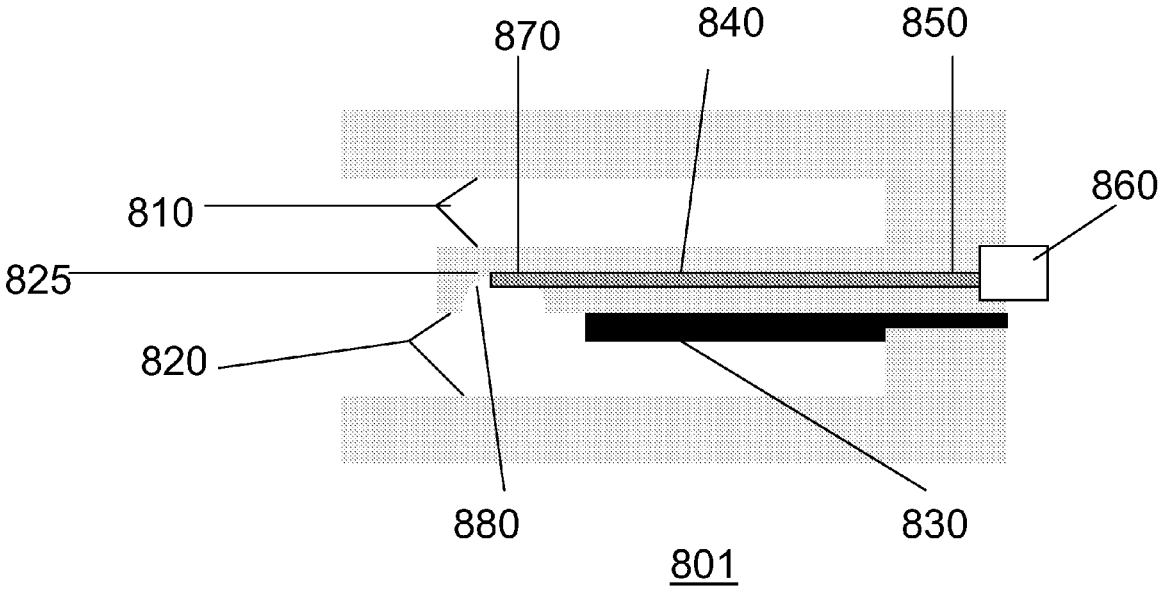

FIG. 8 depicts a preferred aspect of one embodiment where the present invention is a USB socket capable of receiving a USB plug.

Figure 9:
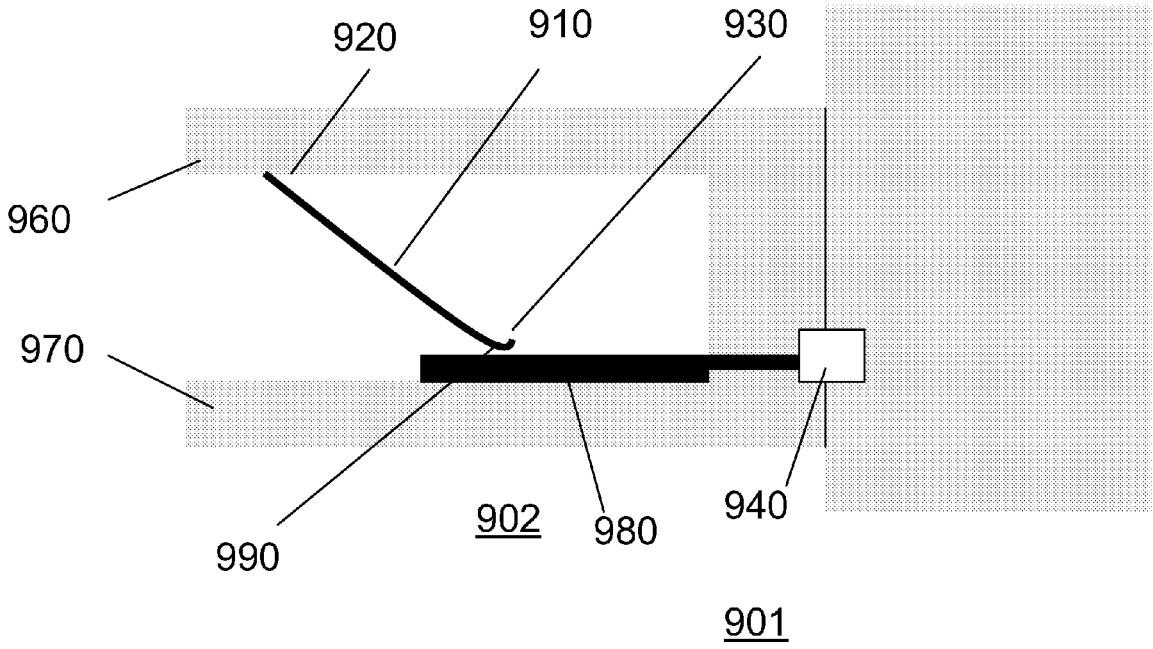

FIG. 9 depicts another embodiment of the present invention where the presented invention is a USB plug having a discharge plane of low resistance and being capable of being received by a USB socket.

DETAILED DESCRIPTION OF THE ILLUSTRATIVE EMBODIMENTS

The present invention relates generally to universal serial bus (USB) connectivity and more particularly relates to an improved USB connection having electrostatic discharge (ESD) protection. The following description is presented to enable one of ordinary skill in the art to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

One embodiment of the present invention includes an apparatus including a USB device having a USB connector and a discharge plane of a low resistance, having a proximate end and a distal end, configured internally to the USB connector wherein one of the distal end or the proximate end is connectable with a ground signal of the USB connector and the axial planar length of the plane is less than the connection planar length of the USB connector.

FIG. 8 depicts a preferred aspect of one embodiment where the present invention is a USB socket (801) capable of receiving a USB plug (not shown). In FIG. 8, the connector (801) also has an upper connection portion (810) and a lower connection portion (820) having signal lines (830), and the grounding plane (840) is arranged between the upper connection (810) and the lower connection portion (820) in a middle connection area (825). Additionally, in a preferred arrangement, the distal end (850) is also connected with the ground signal (860), and the proximate end (870) is arranged to be exposed towards the lower connection portion (820) through the exposed gap area (880). The exposed gap area (880) is of a dimension less than that of the middle connection (825).

In operation, for this preferred embodiment, as a USB device having a USB socket were nearing physical connection with a paired USB device (i.e., a USB plug device), the grounding plane presents an opportunity for excess static charge build up to jump the air gap between the USB plug and the USB socket-based devices. The static charge will jump the air gap without affecting the signal lines of the USB plug or the USB socket device as the ESD charge first comes into contact with the grounding plane as the grounding plane is physically positioned to be first exposed to the potential static charge of the opposite device. It is envisioned that high levels of ESD charge will readily jump the air gap (e.g., 2-3 KV) and lesser amounts are also expected.

FIG. 9 depicts another embodiment of the present invention where the presented invention is a USB plug (902) having a discharge plane of low resistance (910) and being capable of being received by a USB socket (not shown).

In FIG. 9, a USB device (901) having a USB plug (902) and a discharge plane of a low resistance (910), having a proximate end (920) and a distal end (930), configured internally to the USB connector wherein the distal end is connectable with a ground signal (940) of the USB connector (902) and the axial planar length of the plane is less than the connection planar length of the USB plug. The plug also has an upper connection portion (960) and a lower connection portion (970) having signal lines (980), wherein the plane is arranged between said upper connection and said lower connection portion, the distal end is in temporary contact at 990 with said ground signal, and the proximate end is fixedly arranged with the upper connection portion.

FIG. 9 is also illustrative of a preferred methodical embodiment of the present invention comprising the steps of internally arranging a grounding element (910) internal to USB connection (902) of USB device (901).

In operation, for this preferred embodiment, as a USB device having a USB plug were nearing physical connection with a paired USB device (i.e., a USB socket device), the grounding plane presents an opportunity for excess static charge build up to jump the air gap between the USB plug and the USB socket-based devices. The static charge will jump the air gap without affecting the signal lines of the USB plug or the USB socket device as the ESD charge first comes into contact with the grounding plane as the grounding plane is physically positioned to be first exposed to the potential static charge of the opposite device. It is envisioned that high levels of ESD charge will readily jump the air gap (e.g., 2-3 KV) and lesser amounts are also expected.

In a further preferred embodiment, the grounding plane is in flexible contact with the ground of the plug. Preferably, the grounding plane may be configured to be a flexible conductive material or may be affixed to the connector with the assistance of spring or tensionable device to assist the grounding plane to return to its original position after a pair connector is connected and then disengaged.

Many other embodiments of the present invention are also envisioned. For example, in other embodiments, the present invention is directly applicable for kits and improvement configurations to existing USB devices.

As used herein, terms such as personal computers, PCs, systems, and similar terms are intended to be used interchangeably, without distinction or limitation. Such systems may include but not be limited to servers, server-based systems, multi-chipset systems, touch sensitive systems, assemblies and devices therein, etc.

As used herein, the terms "remote", "peripheral", "device", and the like are intended to be used interchangeably but are not intended to be singular or necessarily specific to a particular connection technology such as being hardwired or wireless, but rather such terms are used with the understanding that the terms of interest are in or capable of being in operative communication with a system of the present invention.

Any theory, mechanism of operation, proof, or finding stated herein is meant to further enhance understanding of the present invention and is not intended to make the present invention in any way dependent upon such theory, mechanism of operation, proof, or finding. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow.

In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary. While the invention has been illustrated and described in detail in the drawings and foregoing description, the same is to be considered as illustrative and not restrictive in character, it being understood that only the selected embodiments have been shown and described and that all changes, modifications and equivalents that come within the spirit of the invention as defined herein or by any of the following claims are desired to be protected.

What is claimed is:

1. An apparatus comprising:

USB device having a USB connector and a discharge plane of a low resistance, having a proximate end and a distal end, configured internally to the USB connector wherein one of the distal end or the proximate end is connectable with a ground signal of the USB connector and the axial planar length of the plane is less than the connection planar length of the USB connector, wherein the USB connector is connected with a USB cable, wherein the USB connector is a USB socket capable of receiving a USB plug, the connector having an upper connection portion and a lower connection portion having signal lines, wherein the plane is arranged between the upper connection and the lower connection portion, the distal end is connected with the ground signal, and the proximate end is arranged to be exposed towards the lower connection portion, wherein an exposed air-gap area is formed between a middle connection and the lower connection, and any excess ESD charge may jump and discharge the air-gap area prior to the connection of the USB connector.

2. The apparatus of claim 1 wherein the USB connector is a USB plug capable of being received by a USB socket, the plug having an upper connection portion and a lower connection portion having signal lines, wherein the plane is arranged between the upper connection and the lower connection portion, the distal end is in temporary contact with the ground signal, and the proximate end is fixedly arranged with the upper connection portion.

3. The apparatus of claim 2 wherein the distal end is flexibly arranged where the connector can connect with a USB-paired socket and then return to a predetermined original position upon the connector and socket disengaging.

4. The apparatus comprising a USB connector having an internal discharge plane configurably arranged internal to an upper connection portion and a lower connection portion of the connector, wherein a proximate end of the plane is affixed with the upper connection portion at a predetermined distance from a proximate end of the connector to enable a discharge of static energy prior to the USB connector being connected with a USB-paired connection counterpart, wherein an exposed air-gap area is formed between a middle connection and the lower connection, and any excess ESD charge may jump and discharge the air-gap area prior to the connection of the USB connector.

5. The apparatus of claim 4 further comprising a USB cable in operative communication with the connector, wherein a distal end of the plane is flexibly grounded with a ground of the lower connection portion of the connector.

6. The apparatus of claim 5, further comprising a USB-paired connection counterpart connectably arranged with the connector, wherein the distal end of the plane is connected from ground.

* * * * *

UNITED STATES PATENT AND TRADEMARK OFFICE

CERTIFICATE OF CORRECTION

PATENT NO. : 7,597,572 B2
APPLICATION NO. : 11/528833
DATED : October 6, 2009
INVENTOR(S) : Chapman et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 280 days.

Signed and Sealed this

Twenty-eighth Day of September, 2010

David J. Kappos

David J. Kappos
*Director of the United States Patent and Trademark Office*